US007963406B2

(12) United States Patent
Kinsella

(10) Patent No.: US 7,963,406 B2
(45) Date of Patent: Jun. 21, 2011

(54) LONG GUN STORAGE METHOD

(76) Inventor: Kevin G. Kinsella, Cooksville, IL (US)

( * ) Notice: Subject to any disclaimer, the term of this patent is extended or adjusted under 35 U.S.C. 154(b) by 391 days.

(21) Appl. No.: 12/284,801

(22) Filed: Sep. 24, 2008

(65) Prior Publication Data

US 2009/0078661 A1 Mar. 26, 2009

Related U.S. Application Data

(60) Provisional application No. 60/995,174, filed on Sep. 24, 2007.

(51) Int. Cl.
*A47F 7/00* (2006.01)
*E04G 25/00* (2006.01)

(52) U.S. Cl. ..... 211/64; 248/200.1; 248/205.2

(58) Field of Classification Search ..... 211/4, 8, 211/60.1, 64, 70.4, 70.6, 113, 117, 118; 206/317; 224/913; 42/70.11, 94; 248/200.1, 205.2, 248/206.5, 309.1
See application file for complete search history.

(56) References Cited

U.S. PATENT DOCUMENTS

| | | | | | |
|---|---|---|---|---|---|
| 321,930 | A * | 7/1885 | Wunderlock | 211/64 |
| 554,252 | A * | 2/1896 | Falk | 211/64 |
| 1,202,588 | A * | 10/1916 | Roberts | 312/237 |
| 2,998,885 | A * | 9/1961 | Surface | 211/64 |
| 3,802,612 | A * | 4/1974 | Smith | 224/569 |
| 4,018,339 | A * | 4/1977 | Pritz | 211/8 |
| 4,174,042 | A * | 11/1979 | Fair | 211/8 |
| 4,760,985 | A * | 8/1988 | Stewart et al. | 248/176.1 |
| 5,188,328 | A * | 2/1993 | Thompson | 248/309.2 |
| 5,503,276 | A * | 4/1996 | Pierce | 211/64 |
| 6,427,497 | B1 * | 8/2002 | Mossberg et al. | 70/18 |
| 7,500,572 | B2 * | 3/2009 | Lane et al. | 211/64 |
| 7,770,740 | B2 * | 8/2010 | Punzel et al. | 211/64 |
| 2005/0133473 | A1 | 6/2005 | Lesperance | 211/64 |
| 2007/0170129 | A1 * | 7/2007 | Punzel et al. | 211/64 |

* cited by examiner

*Primary Examiner* — Darnell M Jayne
*Assistant Examiner* — Joshua Rodden
(74) *Attorney, Agent, or Firm* — Philip L. Bateman

(57) ABSTRACT

A method enabling a long gun to be stored upright in a cabinet having a floor and an overhanging surface. The apparatus has: (a) a rod having a thickness less than the inside diameter of the gun barrel and having a length greater than the difference between the height of the surface and the length of the gun, the rod being inserted into the gun barrel; (b) a cap attached to one end of the rod, the cap having a diameter greater than the inside diameter of the gun barrel, the cap limiting the insertion of the rod into the gun barrel; and (c) removably attaching the cap to the underside of the overhanging surface via a magnet or hook-and-loop material.

14 Claims, 1 Drawing Sheet

10
40
30
20

10
50

70
60

LONG GUN STORAGE METHOD

CROSS-REFERENCE TO RELATED APPLICATION

This application claims the benefit of U.S. Provisional Application Ser. No. 60/995,174, Sep. 24, 2007.

FIELD OF THE INVENTION

The invention relates to the upright storage of long guns in a cabinet.

BACKGROUND OF THE INVENTION

Long guns are firearms with long barrels, such as rifles, shotguns, and the like. Long guns are commonly stored in an upright position in cabinets or safes. The terms "cabinet" and "safe" are used interchangeably herein to refer to any container that is adapted for storing long guns in an upright position with a floor and an overhanging surface located a relatively short distance above the tip of the gun barrel. The term "overhanging surface" is used herein to refer to any horizontal surface directly above the tip of the gun barrel and includes shelves, roofs, projections, and the like.

A gun cabinet typically contains slotted racks against which the gun barrels rest. An example of such a gun cabinet is disclosed in Lesperance, U.S. Pat. Appln. Publn. No. 2005/0133473, published Jun. 23, 2005. The slots are generally spaced apart a sufficient distance to accommodate relatively wide long guns, such as bolt-action rifles, double-barrel shotguns, and guns containing scopes. Accordingly, gun cabinets do not provide optimized storage for narrower guns. Another problem with such gun cabinets is that the long guns can fall over if they are not placed in a stable, leaning over position.

Removing a gun from a cabinet is cumbersome. The gun owner must bend down, tip the gun forward with one hand, raise the stock of the gun up with the other hand to clear the door jam, and then slide the stock forward at a 45 degree angle through the slot without scraping the guns behind it. Removing a gun from the back of the cabinet is even more difficult. To remove a gun from the back of the cabinet, it is often necessary to remove many of the guns in the front to create an open pathway. Placing a gun into a cabinet is equally cumbersome.

Another problem associated with conventional gun cabinets is that resting the barrel of the gun against the rack, even if the slots are covered with felt or cloth, causes a deterioration of the bluing on the barrel.

Accordingly, a demand exists for improved long gun storage. One more particular object is to provide long gun storage with the flexibility that enables the gun owner to optimize the positioning of his guns. Another more particular object is to provide long gun storage that eliminates the danger of a gun tipping over. Another more particular object is to provide long gun storage that eliminates any contact against the exterior of the barrel.

SUMMARY OF THE INVENTION

The general object of this invention is to provide improved long gun storage. A more particular object is to provide storage with optimized capacity, easier removal, greater security, and an elimination of damage to the exterior of the gun barrel.

I have invented an apparatus for the upright storage of a long gun having a length and a barrel with an inside diameter in a cabinet having a floor and an overhanging surface at a height greater than the length of the long gun. The apparatus comprises: (a) a rod having a thickness less than the inside diameter of the gun barrel and having a length greater than the difference between the height of the surface and the length of the gun, the rod being adapted for insertion into the gun barrel; (b) a cap attached to one end of the rod, the cap having a thickness greater than the inside diameter of the gun barrel, the cap being adapted for limiting the insertion of the rod into the gun barrel; and (c) a means for removably attaching the cap to the underside of the overhanging surface.

I have also invented a method of storing a long gun having a length and a barrel with an inside diameter in a cabinet having a floor and an overhanging surface at a height greater than the length of the long gun. The method comprises: (a) obtaining an apparatus comprising: (i) a rod having a thickness less than the inside diameter of the gun barrel and having a length greater than the difference between the height of the surface and the length of the gun, the rod being adapted for insertion into the gun barrel; (ii) a cap attached to one end of the rod, the cap having a width greater than the inside diameter of the gun barrel, the cap being adapted for limiting the insertion of the rod into the gun barrel; and (iii) a means for removably attaching the cap to the underside of the overhanging surface; (b) inserting the rod into the barrel of the long gun; (c) placing the long gun in an upright position on the floor of the cabinet; and (d) raising the cap of the apparatus to attach it to the overhanging surface.

The long gun storage apparatus of this invention provides optimal flexibility, increased capacity, easier removal, greater security, and less damage.

DETAILED DESCRIPTION OF THE INVENTION

Figure 1:
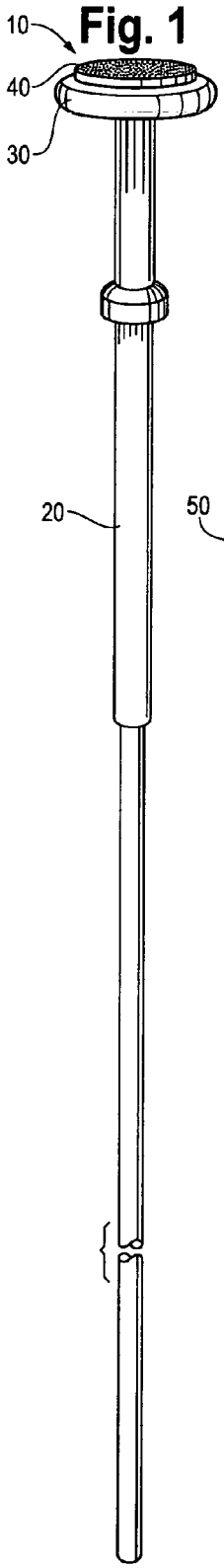
FIG. 1 is a perspective view of the storage apparatus of this invention.

This invention is best understood by the reference to the drawings. FIG. 1 shows a preferred embodiment of the long gun storage apparatus 10 of this invention. The apparatus comprises a rod 20, a cap 30 attached to one end of the rod, and a patch 40 of hook-and-loop fabric attached to the top of the cap. The apparatus enables a long gun 50 to be optimally stored in a cabinet 60 with an overhanging surface 70.

As discussed below, the rod is inserted into the barrel of the long gun. Therefore, the rod has a maximum thickness that is less than the inside diameter of the barrel. In the case where the rod has a round cross section, the thickness of the rod is equal to its outside diameter. The inside diameters of long gun barrels vary from about 17 caliber (0.17 inch) to about 80 caliber (0.80 inch). Accordingly, the thickness of the rod is generally about one-tenth to one-half (0.1 to 0.5) inch. The rod is preferably about one-eighth to three-eighths (about 0.13 to 0.38) inch. The rod is preferably cylindrical (i.e., it has a round cross section) to conform to the shape of the barrel, but other shapes are also suitable.

As also discussed below, the storage apparatus extends from inside the barrel of the gun up to the overhanging surface, generally either a shelf or the roof of a cabinet. Accordingly, the length of the rod is greater than the difference between the height of the shelf and the length of the gun. For example, if the gun has a length of fifty inches and the height of the overhanging surface is fifty-six inches, the rod must have a length greater than six inches. The rod preferably extends downwardly into the barrel for a distance of at least about two inches. Therefore, in the above example, the rod is preferably at least about eight inches long. The rod is generally about two to twenty-four inches long and is preferably about six to eighteen inches long. If the rod is longer than about twenty-four inches, it is more costly to produce, more likely to break, and may even bottom out inside the barrel which could prevent its use with a relatively short gun in a cabinet with a relatively low shelf.

The rod is made of a strong, stiff material that does not bow excessively and that does not scratch or damage the inside of a rifle barrel. Suitable materials include fiberglass, graphite, plastic (e.g., nylon polyamide, polyethylene, polypropylene, polyvinylchloride, etc.), wood, plastic-coated metals, and the like. A nylon rod is preferred because of its strength, resiliency, and ease at sliding into and out of a barrel.

The cap is attached to one end of the rod. The cap is perpendicular to the longitudinal axis of the rod. The cap serves two purposes. The first purpose is to limit the insertion of the rod into the barrel. Without the cap, the rod could easily slide down into the barrel where it could not be retrieved without turning the gun upside down. The second purpose, as discussed in more detail below, is to provide a larger area for the means of removably securing to the underside of the overhanging shelf. Accordingly, the cap is larger in width than the inside diameter of the gun barrel. The cap is preferably a disk having a diameter of about one-half to two inches. The cap is preferably molded as an integral part with the rod.

The cap includes a means for removable attachment to the underside of the overhanging surface. In the preferred embodiment, the top of the cap is covered with a circular patch of hook-and-loop fabric. An example of such fabric is the type sold commercially under the VELCRO trademark. The underside of the overhanging surface is covered with the mating hook-and-loop fabric. It is most preferred that the cap contain a patch of the hook fabric and the overhanging surface be covered with the loop fabric. Another preferred means of removable attachment is a magnetic disk or ring attached to the cap for use with an overhanging shelf made of steel or other ferromagnetic material. Other means of attachment, including multiple receiving holes or slots in the overhanging surface, are also suitable.

A preferred embodiment of the apparatus is-made of nylon and has a length of about sixteen inches. The cap has a diameter of about one inch and contains a patch of VELCRO hook fabric. The upper four inches of the rod portion has a diameter of about one-fourth (about 0.25) inch and the lower twelve inches has a diameter of about three-sixteenths (about 0.19) inch. The thicker, upper portion gives the rod more strength than it would otherwise have. A slightly protruding rib located about midway in the thicker, upper portion provides a gripping surface.

Figure 2:
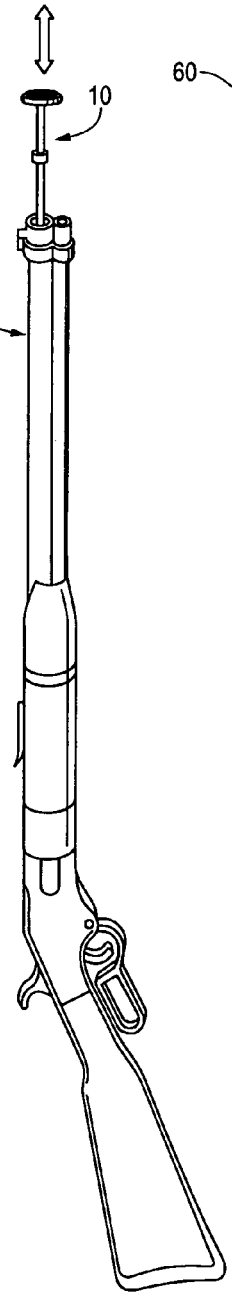
FIG. 2 is a perspective view of the storage apparatus partially inserted into a barrel of a gun.
Figure 3:
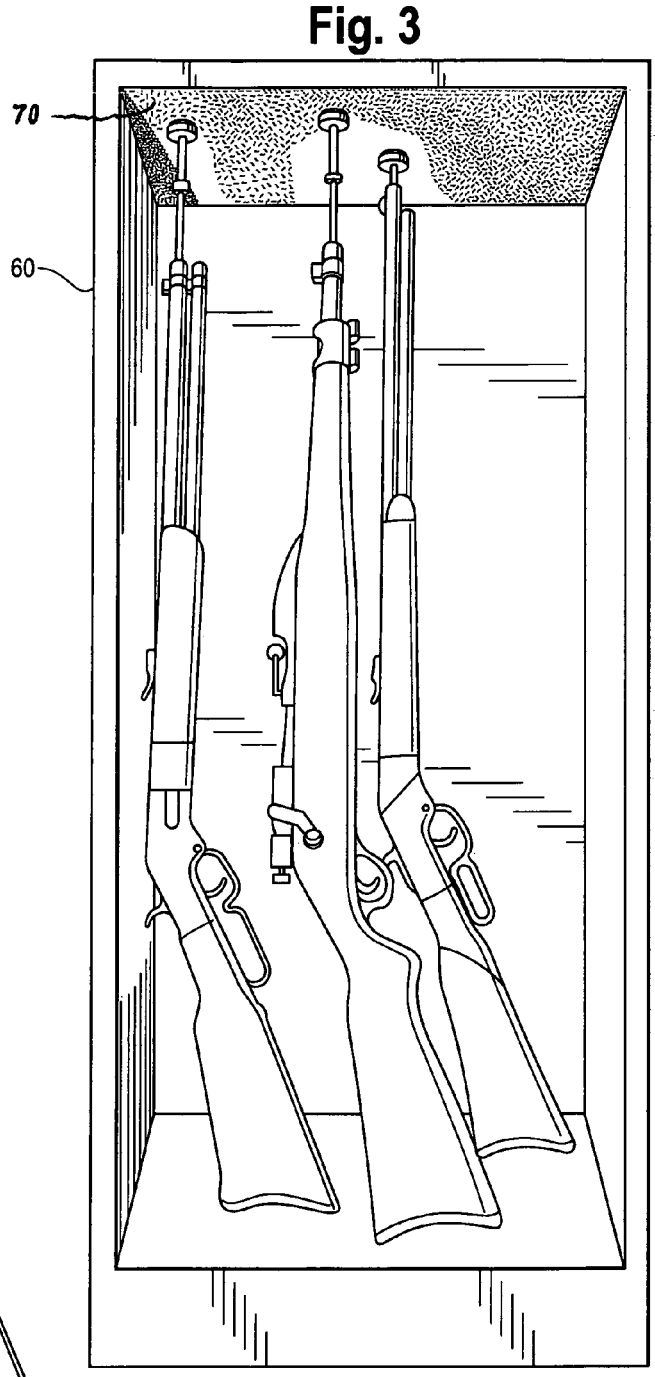
FIG. 3 is a perspective view of a plurality of guns stored in a cabinet.

The use of the long gun storage apparatus can now be considered. FIG. 2 shows the storage apparatus inserted into the barrel of a long gun. FIG. 3 shows three long guns stored in a cabinet whose door is omitted for clarity. The apparatus in each barrel contacts the overhanging roof of the cabinet. To position the gun, the gun owner simply sets the stock of the gun in the desired location and pulls the storage apparatus up until the cap contacts the underside of the overhanging surface. The attachment of the mating hook-and-loop fabrics, magnet, or other means is sufficient to hold the storage apparatus securely in place which, in turn, holds the long gun in place. Once the cap is attached to the surface, there is no danger of the gun tipping over. To remove the gun, the cap is pulled away from the surface, the gun is tilted, and then lifted out.

It can be appreciated that the apparatus gives the gun owner the flexibility to arrange his guns in whatever pattern he wishes in the cabinet. This flexibility enables the gun owner to maximize the number of guns stored in the cabinet, if desired. It also enables the gun owner to quickly and easily change the arrangement as seasons change or as guns are added or removed from his collection. It can also be appreciated that nothing contacts the exterior of the gun barrel during storage. As a result, no damage is done to the finish of the metal.

In most applications, the hook-and-loop fabrics function well without any service for many years. If and when the elements need to be cleaned or replaced, the operation is performed quickly and easily without the use of any tools.

I claim:

1. A method of storing a long gun in a cabinet, the method comprising:

(a) providing a long gun having a length and a barrel with an inside diameter;

(b) providing a cabinet having a floor and a roof or shelf forming an overhanging surface at a height above the floor that is greater than the length of the long gun;

(c) providing a long gun storage apparatus comprising: (i) a rod having a thickness less than the inside diameter of the barrel of the long gun and having a length greater than the difference between the height of the overhanging surface and the length of the long gun, the rod being adapted for insertion into the barrel of the long gun; (ii) a cap attached to one end of the rod, the cap having a width greater than the inside diameter of the barrel of the long gun, the cap being adapted for limiting the insertion of the rod into the barrel of the long gun; and (iii) a means for removably attaching the cap to the overhanging surface, wherein the means for removably attaching the cap to the overhanging surface comprises a first piece of hook-and-loop fabric or a magnet;

(d) inserting the rod of the long gun storage apparatus into the barrel of the long gun;

(e) placing the long gun in an upright position on the floor of the cabinet with the overhanging surface directly above; and (f) raising the cap of the long gun storage apparatus to removably attach it to the overhanging surface.

2. The method of claim 1 wherein the overhanging surface of the cabinet is substantially horizontal and planar.

3. The method of claim 2 wherein the rod of the long gun storage apparatus is cylindrical with a length of about two to twenty-four inches and a diameter of about one-tenth to one-half inch.

4. The method of claim 3 wherein the rod and cap of the long gun storage apparatus are integral.

5. The method of claim 4 wherein the overhanging surface of the cabinet comprises a second piece of hook-and-loop fabric and wherein the means for removably attaching the cap to the overhanging surface comprises the first piece of hook-and-loop fabric which mates with the second piece of hook-and-loop fabric.

6. The method of claim 4 wherein the overhanging surface of the cabinet comprises a ferromagnetic material and wherein the means for removably attaching the cap to the overhanging surface comprises the magnet.

7. The method of claim 4 wherein the rod and cap of the long gun storage apparatus are made of a material selected from the group consisting of fiberglass, graphite, plastic, wood, and plastic-coated metal.

8. A method of storing a long gun in a cabinet, the method comprising:

(a) providing a long gun having a length and a barrel with an inside diameter;

(b) providing a cabinet having a floor and first and second opposing side walls, and a roof or shelf extending from said first opposing side wall to said second opposing side wall to form an overhanging surface at a height above the floor that is greater than the length of the long gun;

(c) providing a long gun storage apparatus consisting essentially of: (i) a rod having a thickness less than the inside diameter of the barrel of the long gun and having a length greater than the difference between the height of the overhanging surface and the length of the long gun, the rod being adapted for insertion into the barrel of the long gun; (ii) a cap attached to one end of the rod, the cap having a width greater than the inside diameter of the barrel of the long gun, the cap being adapted for limiting the insertion of the rod into the barrel of the long gun; and (iii) a means for removably attaching the cap to the overhanging surface;

(d) inserting the rod of the long gun storage apparatus into the barrel of the long gun;

(e) placing the long gun in an upright position on the floor of the cabinet with the overhanging surface directly above; and (f) raising the cap of the long gun storage apparatus to removably attach it to the overhanging surface.

9. The method of claim 8 wherein the overhanging surface of the cabinet is substantially horizontal and planar.

10. The method of claim 9 wherein the rod of the long gun storage apparatus is cylindrical with a length of about two to twenty-four inches and a diameter of about one-tenth to one-half inch.

11. The method of claim 10 wherein the rod and cap of the long gun storage apparatus are integral.

12. The method of claim 11 wherein the overhanging surface of the cabinet comprises a first piece of hook-and-loop fabric and the means for removably attaching the cap to the overhanging surface comprises a second piece of hook-and-loop fabric that mates with the first piece of hook-and-loop fabric.

13. The method of claim 11 wherein the overhanging surface of the cabinet comprises a ferromagnetic material and the means for removably attaching the cap to the overhanging surface comprises a magnet.

14. The method of claim 11 wherein the rod and cap of the long gun storage apparatus are made of a material selected from the group consisting of fiberglass, graphite, plastic, wood, and plastic-coated metal.

* * * * *